US009590369B2

(12) United States Patent
Valenti et al.

(10) Patent No.: US 9,590,369 B2
(45) Date of Patent: Mar. 7, 2017

(54) RJ45 JACKS AND BREAKAWAY RJ45 CABLE ASSEMBLIES USING SAME

(71) Applicant: Panduit Corp., Tinley Park, IL (US)

(72) Inventors: Joshua A. Valenti, Wheeling, IL (US); Robert E. Fransen, Tinley Park, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 14/852,776

(22) Filed: Sep. 14, 2015

(65) Prior Publication Data

US 2016/0099530 A1 Apr. 7, 2016

Related U.S. Application Data

(60) Provisional application No. 62/058,404, filed on Oct. 1, 2014.

(51) Int. Cl.

| | |
|---|---|
| ***H01R 24/64*** | (2011.01) |
| ***H01R 25/00*** | (2006.01) |
| *H01R 13/627* | (2006.01) |
| *H01R 107/00* | (2006.01) |

(52) U.S. Cl.

CPC ..... *H01R 24/64* (2013.01); *H01R 25/006* (2013.01); *H01R 13/6272* (2013.01); *H01R 2107/00* (2013.01)

(58) Field of Classification Search

CPC ..... H01R 13/639; H01R 24/64
USPC ..... 439/344, 354
See application file for complete search history.

(56) References Cited

U.S. PATENT DOCUMENTS

| | | | | |
|---|---|---|---|---|
| 4,074,928 | A | 2/1978 | Johnston | |
| 4,915,643 | A | 4/1990 | Samejima et al. | |
| 5,090,916 | A | 2/1992 | Magnier | |
| 5,462,452 | A | 10/1995 | Devine | |
| 6,905,351 | B1 | 6/2005 | Wang | |
| 7,029,311 | B2 | 4/2006 | Peloza | |
| 7,156,683 | B2 | 1/2007 | Gupta et al. | |
| 7,297,013 | B2 | 11/2007 | Caveney et al. | |
| 7,470,137 | B2 | 12/2008 | Burke et al. | |
| 7,686,638 | B2 | 3/2010 | Boyd et al. | |
| 8,353,715 | B1 | 1/2013 | Zhou | |
| 8,579,646 | B2 | 11/2013 | Lee | |
| 8,840,416 | B2 * | 9/2014 | Huang | H01R 13/4532 439/344 |

(Continued)

OTHER PUBLICATIONS

Telegartner Defined Disconnect CP-Link, drawing No. L00000A0274, Dec. 12, 2011.

*Primary Examiner* — Tulsidas C Patel
*Assistant Examiner* — Marcus Harcum
(74) *Attorney, Agent, or Firm* — Christopher S. Clancy; James H. Williams; Yuri Astvatsaturov

(57) ABSTRACT

The present invention generally relates to the field of network communication. In an embodiment, the present invention is a breakaway RJ45 cable assembly that includes a standard RJ45 plug inserted into a modified RJ45 jack that, upon a sufficient amount of tension, releases the installed standard RJ45 plug. To insure that, as tension builds up in the cable assembly, the connection between the modified RJ45 jack and the patch cord to which the standard RJ45 plug is connected to experience tension substantially along the plug and jack body lengths the breakaway cable assembly is installed in the middle of a communication channel.

7 Claims, 7 Drawing Sheets

(56) References Cited

U.S. PATENT DOCUMENTS

| | | | | |
|---|---|---|---|---|
| 2004/0002243 | A1 | 1/2004 | Mellott | |
| 2004/0092154 | A1* | 5/2004 | Doorhy | H01R 4/2433 439/404 |
| 2006/0035480 | A1 | 2/2006 | Boyd et al. | |
| 2006/0148301 | A1* | 7/2006 | Kim | H01R 13/6272 439/354 |
| 2011/0189863 | A1 | 8/2011 | Sara et al. | |
| 2012/0309220 | A1* | 12/2012 | Su | H01R 13/6275 439/354 |
| 2013/0034985 | A1* | 2/2013 | Lin | H01R 13/447 439/347 |
| 2013/0059454 | A1* | 3/2013 | Cheng | H01R 13/447 439/135 |
| 2013/0260581 | A1* | 10/2013 | Kuo | H01R 13/627 439/138 |

* cited by examiner

RJ45 JACKS AND BREAKAWAY RJ45 CABLE ASSEMBLIES USING SAME

RELATED APPLICATIONS

This application claims the benefit of U.S. Provisional Patent Application No. 62/058,404, filed on Oct. 1, 2014, which is incorporated herein by reference in its entirety.

FIELD OF INVENTION

The present invention generally relates to the field of network communication, and more specifically, to jacks and assemblies designed to release an RJ45 plug without substantial damage thereto.

BACKGROUND

RJ45 plugs and jacks are generally designed to prevent unintentional disconnection. This is typically achieved by providing vertical face-to-face interaction between the plug latch tabs and the jack housing, where the interaction is disengaged when a user depresses the plug latch. Such design can be advantageous in settings where unintentional large tensions are not likely to be applied on the mated plug/jack combination. However, in other scenarios such designs may actually contribute to potential equipment damage.

For instance, a problem can occur where an end user forgets to disconnect an RJ45 patch cord in a mobile application and a relatively large tension is applied along a patch cord which puts expensive equipment at risk of damage. One example of where this situation is a common occurrence is in hospitals where technicians are rapidly changing locations between patients with a mobile cart of equipment and, when leaving quickly in case of an emergency for example, forgets to disconnect network connectivity damaging a network port in the process. Such damage can result in downtime and significant repair costs.

An additional element of this problem is that the directionality of the pull on the network connectivity is not consistent. In cases where the direction of pull is along that of the plug body length, the plug itself is more likely to fail. However, as the angle increases to be more perpendicular to that of the plug body length the RJ45 plug is more likely to bind to the side of the jack housing causing damage to the equipment.

As such, there is a need for devices, systems, and methods which provide a secure RJ45 connection under normal conditions, and yet help reduce the withdrawal force of an RJ45 plug when the plug is engaged such that upon a sudden application of tension in the cable the cable is withdrawn in a non-destructive manner.

SUMMARY

Accordingly, at least some embodiments of the present invention are directed towards devices, systems, and methods which provide a secure RJ45 connection under normal conditions, and yet help reduce the withdrawal force of an RJ45 plug when the plug is engaged such that upon a sudden application of tension in the cable the cable is withdrawn in a non-destructive manner.

In an embodiment, the present invention is a breakaway RJ45 cable assembly that includes a standard RJ45 plug inserted into a modified RJ45 jack that, upon a sufficient amount of tension, releases the installed standard RJ45 plug.

To insure that, as tension builds up in the cable assembly, the connection between the modified RJ45 jack and the patch cord to which the standard RJ45 plug is connected to experience tension substantially along the plug and jack body lengths the breakaway cable assembly is installed in the middle of a communication channel.

In another embodiment, the present invention is an RJ45 communication jack for receiving an RJ45 plug, the RJ45 plug having a plug latch with a stop surface. The jack includes a housing for receiving the RJ45 plug, the housing including a side being positioned adjacent to the RJ45 plug latch when the RJ45 plug is received within the RJ45 communication jack, the side including a flexible member, the flexible member including at least one plug-latch-stop configured to interact with the plug latch when the RJ45 plug is received within the RJ45 communication jack.

In yet another embodiment, the present invention is an RJ45 communication cord. The cord includes a twisted pair cable and an RJ45 communication jack connected to at least one end of the twisted pair cable, the RJ45 communication jack configured to receive an RJ45 plug having a plug latch with a stop surface, the RJ45 communication jack including a housing for receiving the RJ45 plug, the housing having a side being positioned adjacent to the RJ45 plug latch when the RJ45 plug is received within the RJ45 communication jack, the side including a flexible member, the flexible member including at least one plug-latch-stop configured to interact with the plug latch when the RJ45 plug is received within the RJ45 communication jack.

In still yet another embodiment, the present invention is an RJ45 communication jack, the jack having an axis of an RJ45 plug insertion, the RJ45 plug having a plug latch. The jack includes a housing with a housing front defining an opening for receiving the RJ45 plug therethrough, and a housing side, the housing side being positioned adjacent to the RJ45 plug latch when the RJ45 plug is received within the RJ45 communication jack, the housing side including a substantially rectangular flexible member having four flexible member sides, the flexible member being secured to the housing side along one of the four flexible member sides.

These and other features, aspects, and advantages of the present invention will become better-understood with reference to the following drawings, description, and any claims that may follow.

DETAILED DESCRIPTION

Figure 1:
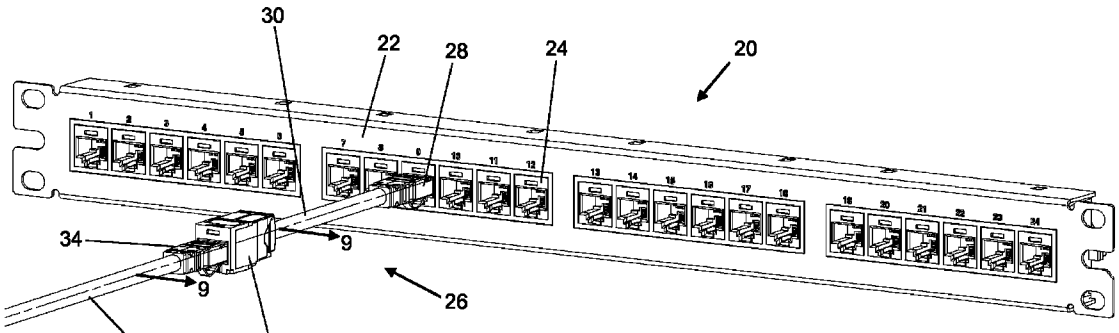
FIG. 1 illustrates a communication system according to an embodiment of the present invention.
Figure 2:
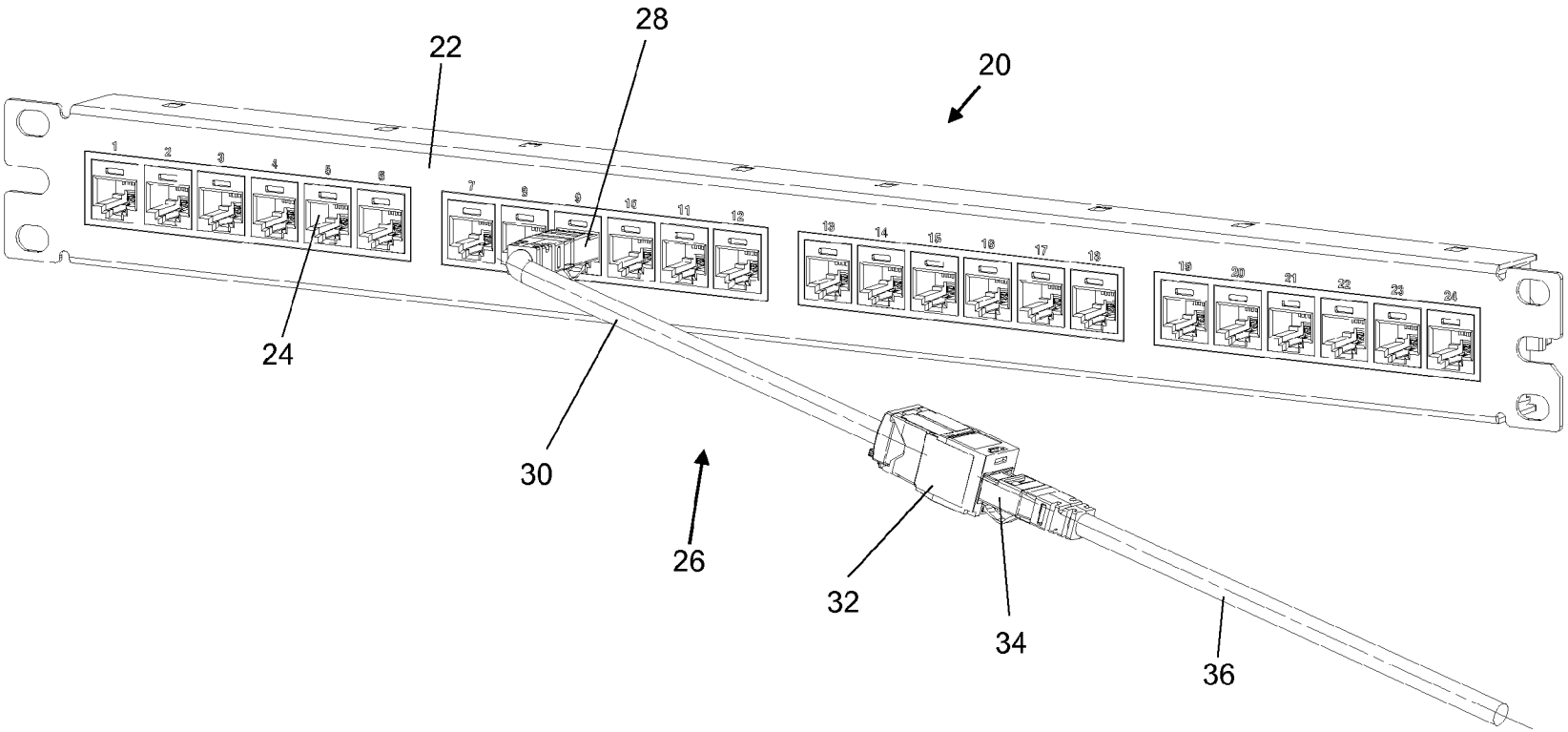
FIG. 2 illustrates a communication system according to an embodiment of the present invention.

Referring to FIG. 1, an embodiment of the present invention includes a communication system 20 with patch panel 22 populated with RJ45 jacks 24, a breakaway RJ45 cable assembly 26, and an RJ45 patch cord 34. The breakaway RJ45 cable assembly 26 includes an RJ45 plug 28, a cable 30 with central axis 36, and a breakaway RJ45 jack 32. Plug 28 is installed into jack 24 and RJ45 patch cord 34 is installed into breakaway jack 32 via an RJ45 plug. FIG. 2 illustrates communication system 20 with the orientation of the installation of cable assembly 26 changed to demonstrate that the direction of the cable 30 and the patch cord 34 remain approximately in line with that of central axis 36 of breakaway RJ45 jack 32.

While equipment 22 is illustrated as a patch panel in FIGS. 1 and 2, current systems can include passive and/or active equipment. Examples of passive equipment can be, but are not limited to, modular patch panels, punch-down patch panels, coupler patch panels, faceplates, surface mount box, media distribution unit (MDU), wall jacks, etc. Examples of active equipment can be, but are not limited to, Ethernet switches, routers, servers, physical layer management systems, and power-over-Ethernet equipment as can be found in data centers/telecommunications rooms; security devices (cameras and other sensors, etc.) and door access equipment; and telephones, computers, fax machines, printers and other peripherals as can be found in workstation areas. Communication system 20 can further include cabinets, racks, cable management and overhead routing systems, and other such equipment; and application specific devices such as, in healthcare applications, biomedical instruments, diagnostic and treatment equipment such as might be found in a hospital or other such environment.

Figure 3:
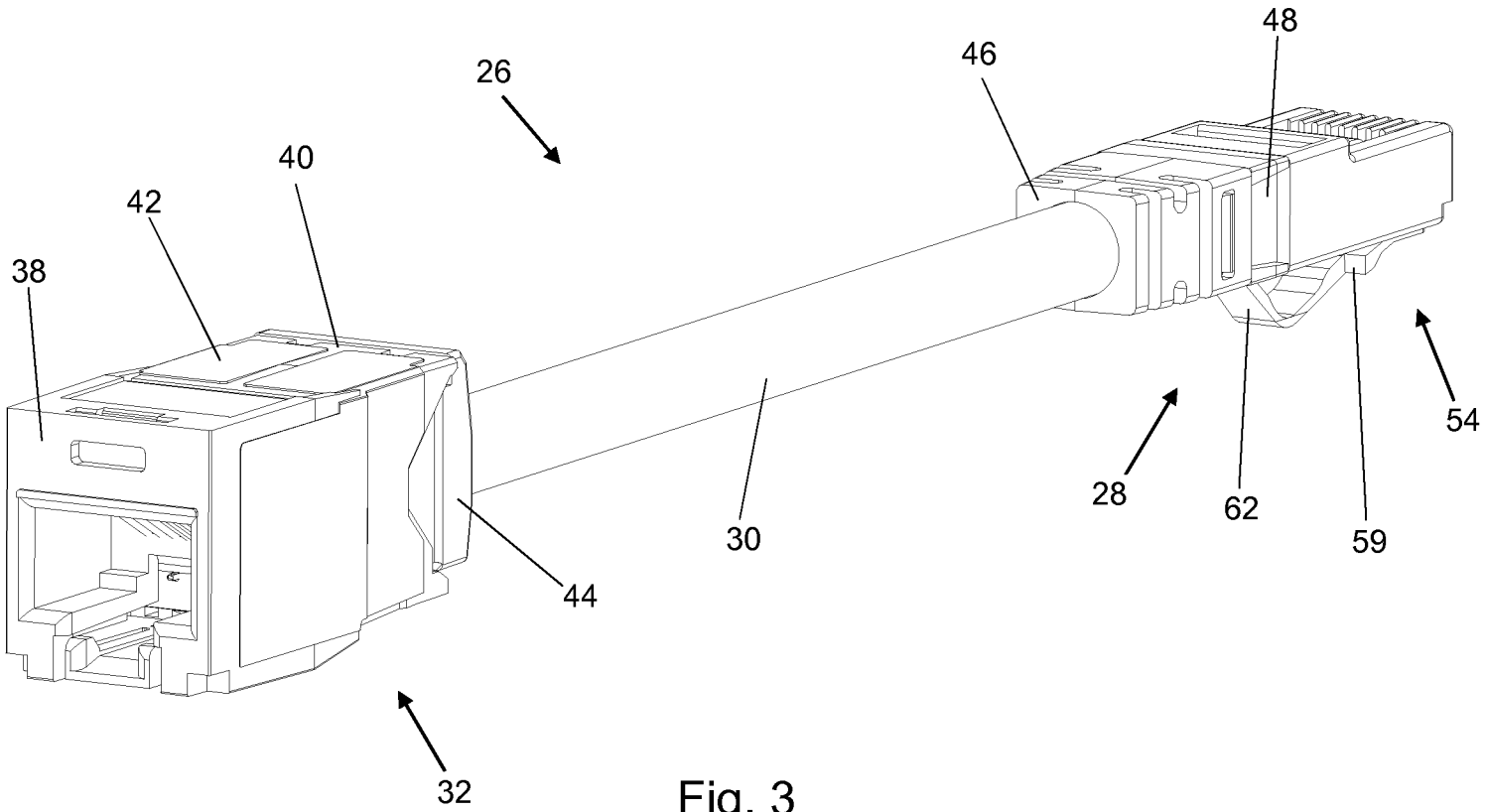
FIG. 3 illustrates an embodiment of an assembly according to the present invention.
Figure 4:
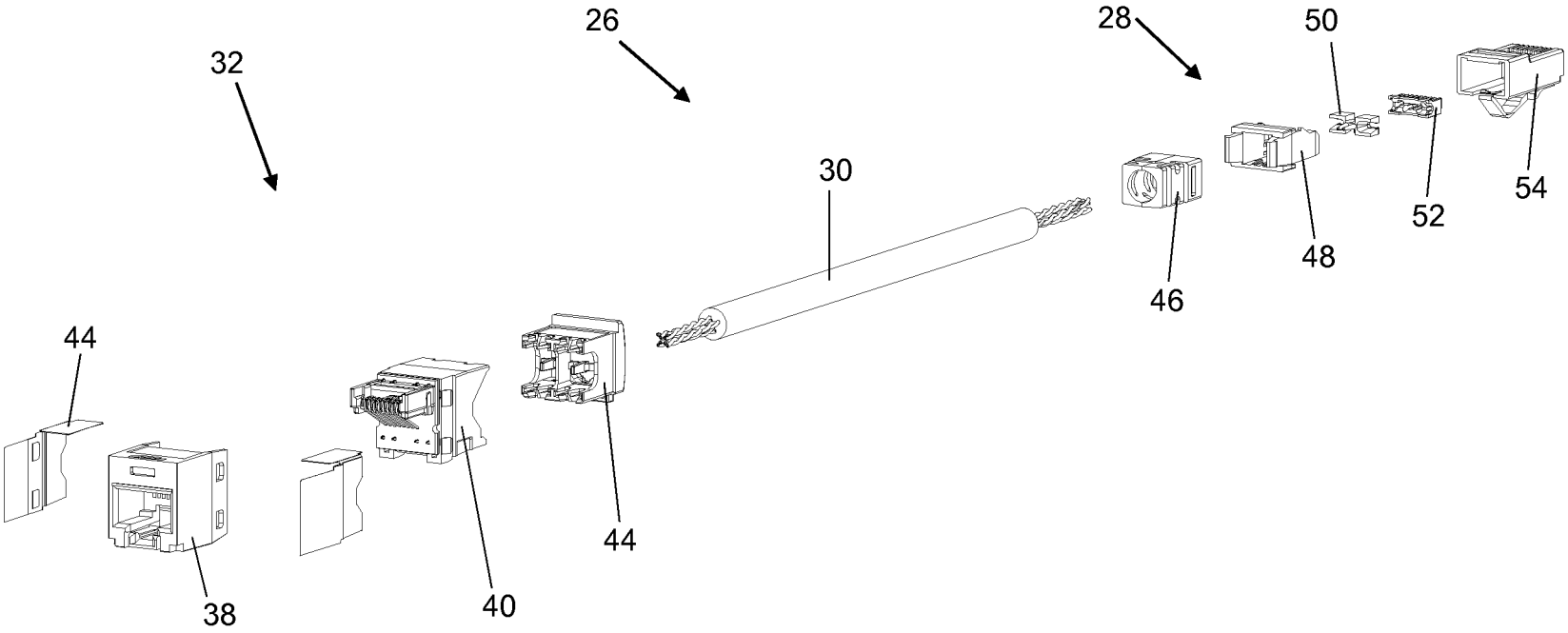
FIG. 4 illustrates an exploded view of the assembly of FIG. 3.
Figure 5:
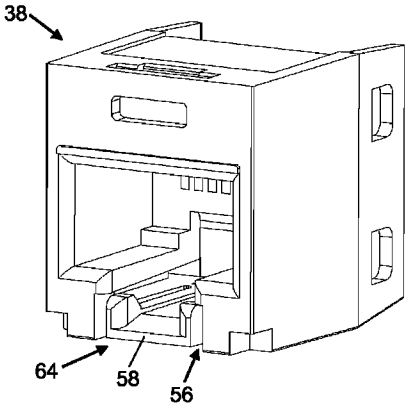
FIG. 5 illustrates a front perspective view of a jack housing from the assembly of FIG. 3.
Figure 6:
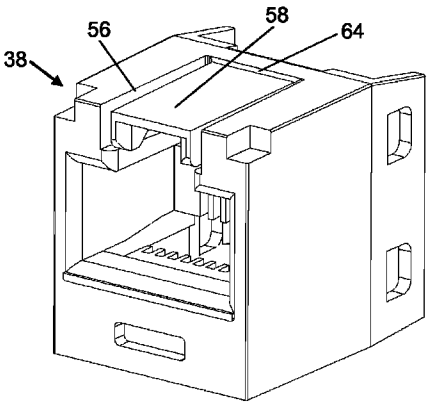
FIG. 6 illustrates a front perspective view of a jack housing from the assembly of FIG. 3.
Figure 7:
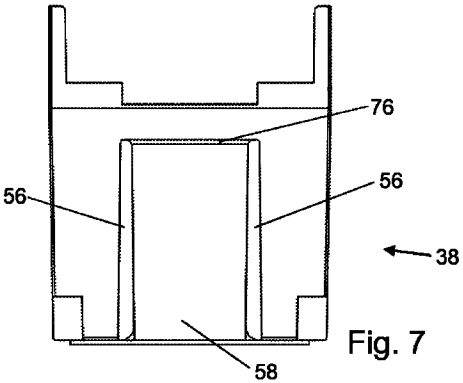
FIG. 7 illustrates a top view of a jack housing from the assembly of FIG. 3.
Figure 8:
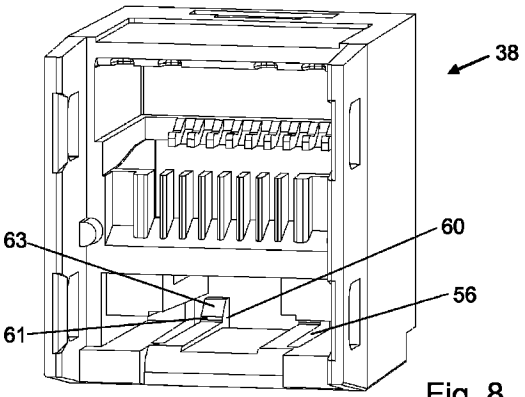
FIG. 8 illustrates a rear perspective view of a jack housing from the assembly of FIG. 3.

FIGS. 3 and 4 illustrate the breakaway cable assembly 26 in greater detail. As shown therein, the assembly 26 includes breakaway jack housing 38, sled assembly and rear jack portion 40, foil 42, wire cap 44, twisted pair cable 30, and plug assembly 28. Plug assembly 28 includes plug boot 46, strain relief collar 48, divider 50, load bar 52, and plug housing assembly 54 with a plug latch 62 and tabs 59.

Referring to FIGS. 5-8, the jack housing 38 includes a flexible member 58 positioned on the top of the jack housing and adjacent to the plug/jack latching point. In the currently described embodiment, the flexibility of the flexible member 58 is achieved by providing cut-outs 56 positioned along the two parallel sides of the flexible member 58. The cut-outs 56 partially detach the flexible member 58 from the rest of the jack housing 38, enabling a predetermined level of flexibility.

The jack housing 38 further includes modified plug-latch-stops 60 positioned accordingly to interact with tabs 59 of the plug latch 62. The plug-latch-stops 60 include a vertical surface 61 and an angled surface 63, both of which are illustrated in the rear view of the jack housing shown in FIG. 8. While the angled surface is illustrated as a flat surface, in other embodiments the surface may be evenly or unevenly curved. In addition, there may be one or more flat or curved intermediate sections positioned between the angled surface 63 and a vertical surface 61. Furthermore, the vertical surfaces 61 may vary in size, or they may be omitted altogether.

Figure 9:
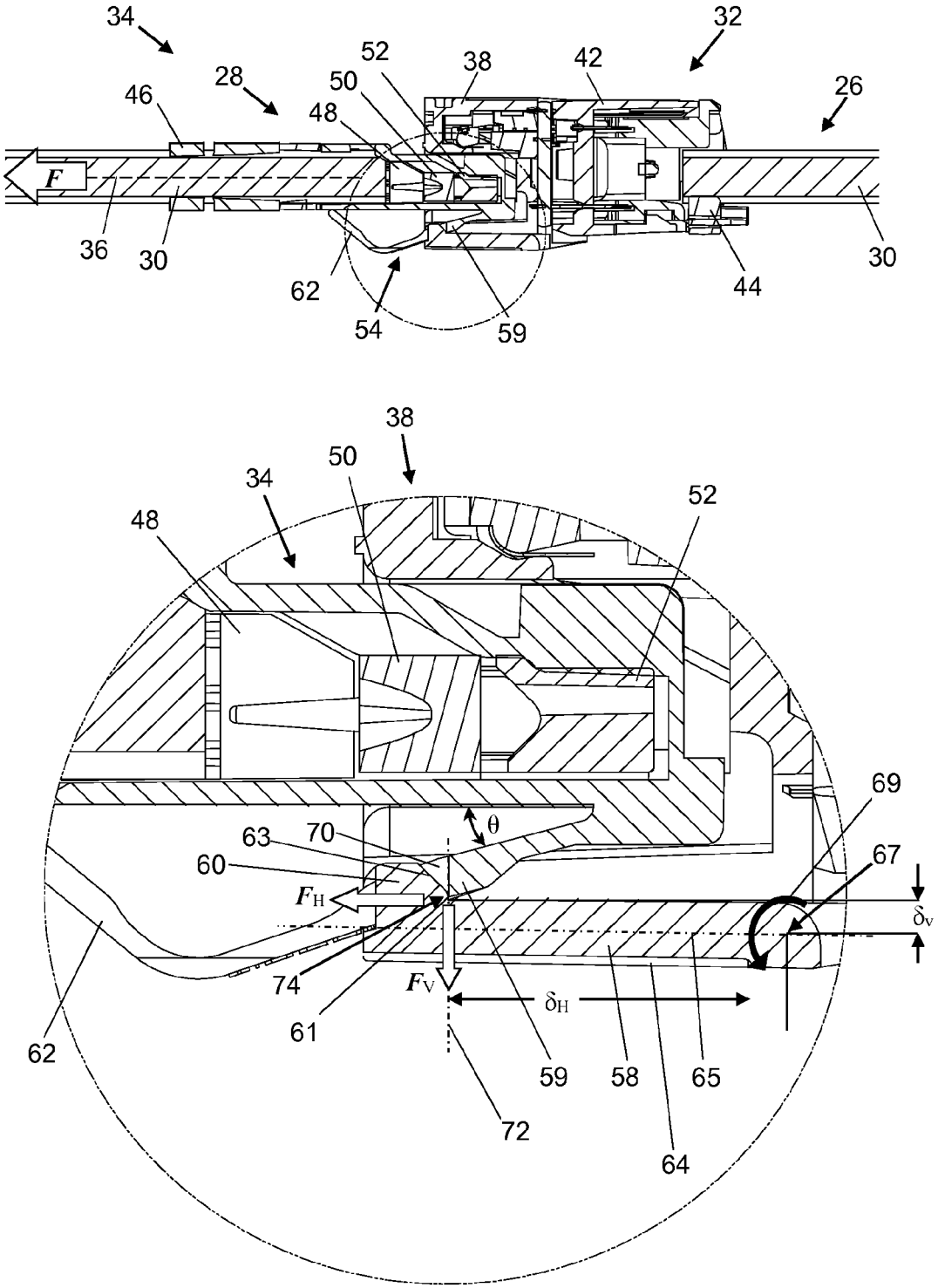
FIG. 9 illustrates a cross-sectional view of the assembly of FIG. 3 mated with an RJ45 plug.

The interaction of the latching mechanism of a standard RJ45 plug and the catching mechanism of the modified RJ45 jack is illustrated in some detail in FIG. 9 which is a cross-section view of a mated plug/jack combination taken about section line 9-9 of FIG. 1. When the standard RJ45 plug 68 is fully mated with the modified RJ45 jack 32, the tabs 59 positioned on the plug latch 62 are constrained by the plug-latch-stops 60 of the jack housing 38, causing the plug 68 to remain within the jack 32 until sufficient pulling force is applied. In a case where the plug-latch-stops 60 include a vertical surface 61, the vertical surface 61 and the rear vertical surface 70 of the tabs 59 provide added restraint of the plug since the plane 72 defined by the two interacting surfaces 61, 70 is approximately perpendicular to the axis 36 along which the majority of pulling tension would be experienced.

While the interaction of the latching components detailed in FIG. 9 provides some restraint of the plug assembly 28 and prevents relatively low tension disconnects, it allows the plug and the jack to non-destructively disconnect upon application of sufficient pulling force substantially along the axis 36. Due to the interaction between the tabs 59 and the plug-latch-stops 60, the plug latch 62, and thereby the plug 68, are prevented from unrestricted withdrawal. However, in the event of longitudinal tension force F across the plug/jack combination and along the central axis 36, the plug assembly 28 and the jack 32 begin to separate provided that force F is sufficiently large to overcome the engagement between plug latch 62 and plug-latch-stops 60. In the detail view of FIG. 9, horizontal component force $F_H$ and the vertical component of force $F_V$ are shown at the point of interaction 74. Horizontal component force $F_H$ is approximately equal to force F along the central axis 36. Variation between these forces comes from frictional effects and any forces that the jack contacts exert onto plug assembly 28 in the horizontal direction. Vertical component of force $F_V$ is a resultant of the flexibility of plug latch 62 and its angle θ relative to the horizontal direction. Because flexible member 58 is attached to the housing 38 at its rear 76, (see FIG. 7), the deflection of the flexible member 58 translates into a rotation thereof at or about point 67 due to moment M 69 in the counter-clockwise direction relative to the orientation of FIG. 9. In the static system (prior to plug assembly 28 releasing from jack housing 38) moment M 69 can be calculated as:

$$M=(F_H*\delta v)+(F_V*\delta_H) \quad \text{Eqn. (1)}$$

where $\delta_v$ is the vertical distance between point of interaction 74 and central flexure axis 65 and $\delta_H$ is the horizontal distance between point of interaction 74 and point 67 (reference detail view of FIG. 9). It is worth noting that the above equation represents the static system prior to plug assembly 28 releasing from jack housing 38. As forces increase, moment M 69 will also increase resulting in additional flexure in member 58 until plug assembly 28 releases from jack housing 38 in a dynamic manner.

This rotation of flexible member 58 alters the angle α of the plane 72 relative to the angle of the central axis 65 causing α to increasingly deviate from 90° as greater tension is applied. While at relatively low a deviations the friction between the tabs 59 and the plug-latch-stops 60 prevents the latch 62 from being released, at a sufficient angle α this friction is reduced to the point where the tabs 59 slip relative to the plug-latch-stops 60. The point at which this slippage occurs may be adjusted in any number of ways, including, but not limited to, adjusting the size and/or shape of the plug-latch-stops 60 (including vertical surfaces 61 and/or angled surfaces 63), adjusting the materials from which the flexible member 58 is made, and adjusting the size/length/thickness of the flexible member 58. Since prior to the slippage of the tabs 59 relative to the plug-latch-stops 60 the plug latch 62 also deflects in the direction relatively parallel to that of plane 72, it is preferable to design the point at which the slippage occurs prior to the plug latch 62 deflecting to the point of plastic deformation. Likewise, it is also preferable to design the point at which the slippage occurs prior to the flexible member 58 deflecting to the point of plastic deformation. In an embodiment, the deflection of the latch 62 and/or the flexible member 58 ranges from greater than 0° to about 15° relative to the central axis 36.

Upon slipping, the tabs 59 first clear the vertical surfaces 61 of the plug-latch-stops 60 and thereafter come into contact with the angled surfaces 63. Because the angles of the angled surfaces 63 relative to the rear vertical surfaces 70 is greater than that of the vertical surfaces 61 relative to the rear vertical surfaces 70, the tabs continue to slip past the angled surfaces 63, clearing the plug-latch-stops 60 and allowing the latch 62 and the flexible member 58 to deflect back into their rested/default positions. This releases the plug 68 from the jack 32.

Referring back to FIGS. 5 and 6, a relief area 64 can be provided above the flexible member 58 to provide room for the flexible member 58 to deflect. This feature may be useful in embodiments where without the relief 64 the installation environment could constrain flexible member 58 and prevent proper deflection.

In an embodiment, the jack 32 includes the following characteristics:

TABLE 1

| Example | Length of flexible member 58 | Height of angled surfaces 63 | Radius of intermediate sections | Force (lb.) for release |
|---|---|---|---|---|
| 1 | 0.3 in | 0.03 in | 0.01 in | 8-13 |
| 2 | 0.45 in | 0.035 in | 0.01 in | 2-4 |
| 3 | 0.3 in | 0.035 in | 0.01 in | 5-9 |

where the length of the flexible member 58 is measured from the tip thereof near the front of the jack housing 38 to its rear 76; the height of angled surfaces 63 is measured vertically relative to the length of the jack 32; the radius of intermediate sections is the measure of the radius of a curved intermediate sections positioned between the vertical sections 61 and the angled surfaces 63, and the force for release is a measure of force needed to release a standard RJ45 plug from the jack with the corresponding characteristics. All measurements in Table 1 can be varied by +/−5%; alternatively, measurements in Table 1 can be varied by +/−10% or +/−20%, for examples.

Figure 10:
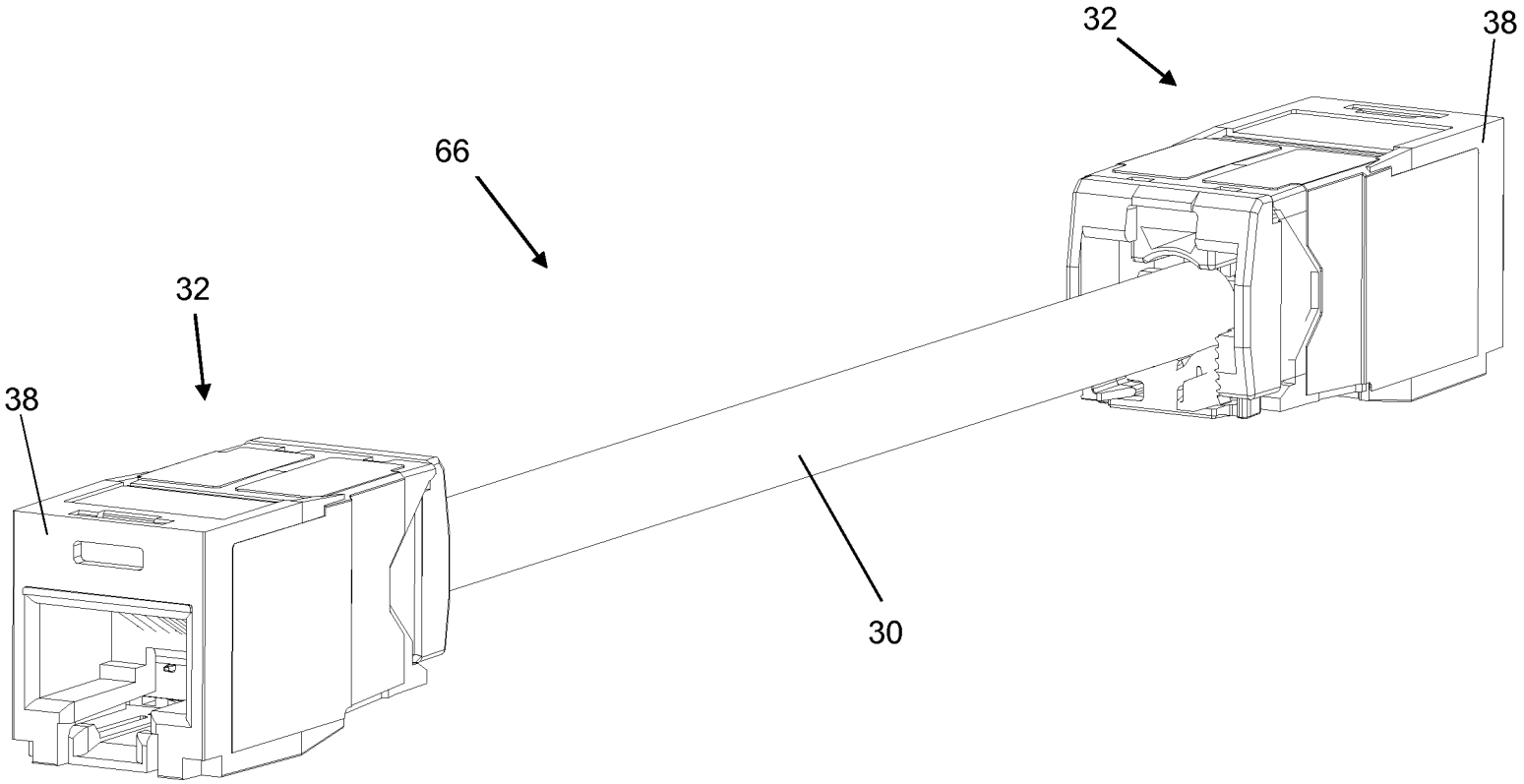
FIG. 10 illustrates an embodiment of an assembly according to the present invention.

An alternate embodiment of a breakaway RJ45 cable assembly according to the present invention is shown in FIG. 10 where the assembly 66 includes a jack to jack configuration where both ends utilize breakaway housing 38. In yet another embodiment, the breakaway housing 38 is used inside a piece of passive and/or active equipment akin to jack 24 shown in FIGS. 1 and 2.

Note that while this invention has been described in terms of several embodiments, these embodiments are non-limiting (regardless of whether they have been labeled as exemplary or not), and there are alterations, permutations, and equivalents, which fall within the scope of this invention. Additionally, the described embodiments should not be interpreted as mutually exclusive, and should instead be understood as potentially combinable if such combinations are permissive. It should also be noted that there are many alternative ways of implementing the methods and apparatuses of the present invention. It is therefore intended that claims that may follow be interpreted as including all such alterations, permutations, and equivalents as fall within the true spirit and scope of the present invention.

We claim:

1. An Ethernet jack for receiving an Ethernet plug, said Ethernet plug having a plug latch with a stop surface, said Ethernet jack comprising:

a housing defining a cavity for receiving said Ethernet plug, said housing including a side being positioned adjacent to said Ethernet plug latch when said Ethernet plug is received within said Ethernet jack, said side including a flexible member, said flexible member including at least one plug-latch-stop configured to interact with said plug latch when said Ethernet plug is received within said Ethernet jack, said at least one plug-latch-stop including a plurality of surfaces facing said cavity, said plurality of surfaces including at least one angled surface configured to interact with at least one of said stop surface and an edge of said stop surface when said Ethernet plug and said Ethernet jack are being disconnected, said plurality of surfaces further including a secondary surface configured to contact said stop surface when said Ethernet plug is received within said Ethernet jack.

2. The Ethernet jack of claim 1, wherein said secondary surface is at least approximately a vertical surface.

3. An Ethernet cord, comprising:

a twisted pair cable; and an Ethernet jack connected to at least one end of said twisted pair cable, said Ethernet jack configured to receive an Ethernet plug having a plug latch with a stop surface, said Ethernet jack including a housing defining a cavity for receiving said Ethernet plug, said housing having a side being positioned adjacent to said Ethernet plug latch when said Ethernet plug is received within said Ethernet jack, said side including a flexible member, said flexible member including at least one plug-latch-stop configured to interact with said plug latch when said Ethernet plug is received within said Ethernet jack, said at least one plug-latch-stop including a plurality of surfaces facing said cavity, said plurality of surfaces including at least one angled surface configured to interact with at least one of said stop surface and an edge of said stop surface when said Ethernet plug and said Ethernet jack are being disconnected, said plurality of surfaces further including a secondary surface configured to contact said stop surface when said Ethernet plug is received within said Ethernet jack.

4. The Ethernet cord of claim 3, wherein said secondary surface is at least approximately a vertical surface.

5. A communication system, comprising:

a communication equipment; and an Ethernet jack connected to said communication equipment, said jack for receiving an Ethernet plug having a plug latch with a stop surface, said jack including a housing defining a cavity for receiving said Ethernet plug, said housing including a side being positioned adjacent to said Ethernet plug latch when said Ethernet plug is received within said Ethernet jack, said side including a flexible member, said flexible member including at least one plug-latch-stop configured to interact with said plug latch when said Ethernet plug is received within said Ethernet jack, said at least one plug-latch-stop including a plurality of surfaces facing said cavity, said plurality of surfaces including at least one angled surface configured to interact with at least one of said stop surface and an edge of said stop surface when said Ethernet plug and said Ethernet jack are being disconnected, said plurality of surfaces further including a secondary surface configured to contact said stop surface when said Ethernet plug is received within said Ethernet jack.

6. The communication system of claim 5, wherein said secondary surface is at least approximately a vertical surface.

7. The communication system of claim 5, wherein said communication equipment is at least one of a patch panel, a faceplate, a surface mount box, a media distribution unit, a wall jack, an Ethernet switch, a router, a server, a physical layer management system, a power-over-Ethernet equipment, a security devices, a door access equipment, a telephone, a computer, a fax machine, a printer, a biomedical instrument, a healthcare diagnostic equipment, and a healthcare treatment equipment.

* * * * *